US006769144B1

(12) United States Patent
Bruske

(10) Patent No.: US 6,769,144 B1
(45) Date of Patent: Aug. 3, 2004

(54) TEXTILE ARTICLE

(75) Inventor: Beth Bruske, City of Commerce, CA (US)

(73) Assignee: David Textiles, Inc., City of Commerce, CA (US)

( * ) Notice: Subject to any disclaimer, the term of this patent is extended or adjusted under 35 U.S.C. 154(b) by 0 days.

(21) Appl. No.: 10/410,331

(22) Filed: Apr. 10, 2003

(51) Int. Cl.[7] ..... A47C 31/10

(52) U.S. Cl. ..... 5/482; 5/499; D6/603

(58) Field of Search ..... 5/482, 499, 500, 5/502; D6/603; 428/32

(56) References Cited

U.S. PATENT DOCUMENTS 6,427,265 B1 * 8/2002 Dix ..... 5/482

* cited by examiner

*Primary Examiner*—Teri Pham Luu
(74) *Attorney, Agent, or Firm*—Rapkin, Gitlin & Beaumont

(57) ABSTRACT

A generally rectangular shaped textile fabric article having a top surface and a bottom surface with indicia disposed over all or portions of these surfaces. The fabric article is further defined by four sides with a border comprised of a plurality of simulated enlongated fringe strips situated in juxtaposed relation. The simulated fringe is easily and economically converted to individual pieces of fringe material by separating the pieces along prescribed lines and color indicators and can embody indicia and/or colors that effectively coordinate or contrast with the indicia and/or colors displayed on the surface(s) of the article.

5 Claims, 2 Drawing Sheets

TEXTILE ARTICLE

BACKGROUND OF THE INVENTION

1. Field of the Invention

The present invention relates generally to the field of textiles and more particularly to a fabric blanket or "throw" with convertible simulated fringe borders.

2. Description of the Prior Art

Blankets or "throws" made of any suitable fabric material are well known in the prior art. Equally as well known are certain kinds of embellishments of these materials, including fringed borders. Fringes can be added as a separate component to the "throw" as pieces of thread or thread-like material attached along opposite sides or along all four sides of the article. Fringes can take other forms, for examples, such as strips of various materials or strands of rope or cord. Fringe materials can be loose hanging or tied in bunches, and are offered in a variety of contrasting or coordinating colors and textures.

However, nothing in the prior art includes a blanket or "throw" covering, or the like, that integrates a border that simulates or mocks a fringe component and then is easily, convertible to actual individual pieces of fringe material by separating the pieces in so many variations along prescribed lines and color indicators.

The present invention is directed to a fabric covering with borders that simulate a fringe component and easily convert to individual pieces of fringe material that can be color coordinated and size adjusted according to the user's interest and election.

SUMMARY OF THE INVENTION

In its preferred embodiment, the present invention provides a generally rectangular textile fabric article having a top-surface and a bottom surface with indicia disposed over all or portions of these surfaces. The article is further defined by four (4) sides with a border comprised of a plurality of simulated elongated fringe strips situated in juxtaposed relation. The simulated fringe is easily and economically converted to individual pieces of fringe material by separating the pieces to allow for a variety of creative and aesthetic effects along prescribed lines and color indicators. The fringe strips can embody indicia and/or colors that effectively coordinate or contrast with the indicia and/or colors displayed on the surface(s) of the article.

Accordingly, it is an object of the present invention to provide an improved fabric "throw".

Another object of the present invention is to provide an improved fabric "throw" with a simulated fringe component.

Still another object of the present invention is to provide an improved fabric "throw" with a simulated fringe component that is easily and economically converted to individual pieces of fringe material by separating the pieces to allow for a variety of creative and aesthetic effects along prescribed lines and color indicators.

Still another object of the present invention is to provide an improved fabric "throw" with fringe strips that embody indicia and/or colors that effectively coordinate and contrast with the indicia and/or colors displayed on the principal surface(s) of the fabric.

Still another object of the present invention is to provide a "throw" with a simulated fringe component that is easy and cost effective to manufacture.

Other objects and advantages of the present invention will become apparent in the following specifications when considered in light of the attached drawings wherein the preferred embodiment of the invention is illustrated.

DETAILED DESCRIPTION OF THE PREFERRED EMBODIMENT

Figures 1, 1A:
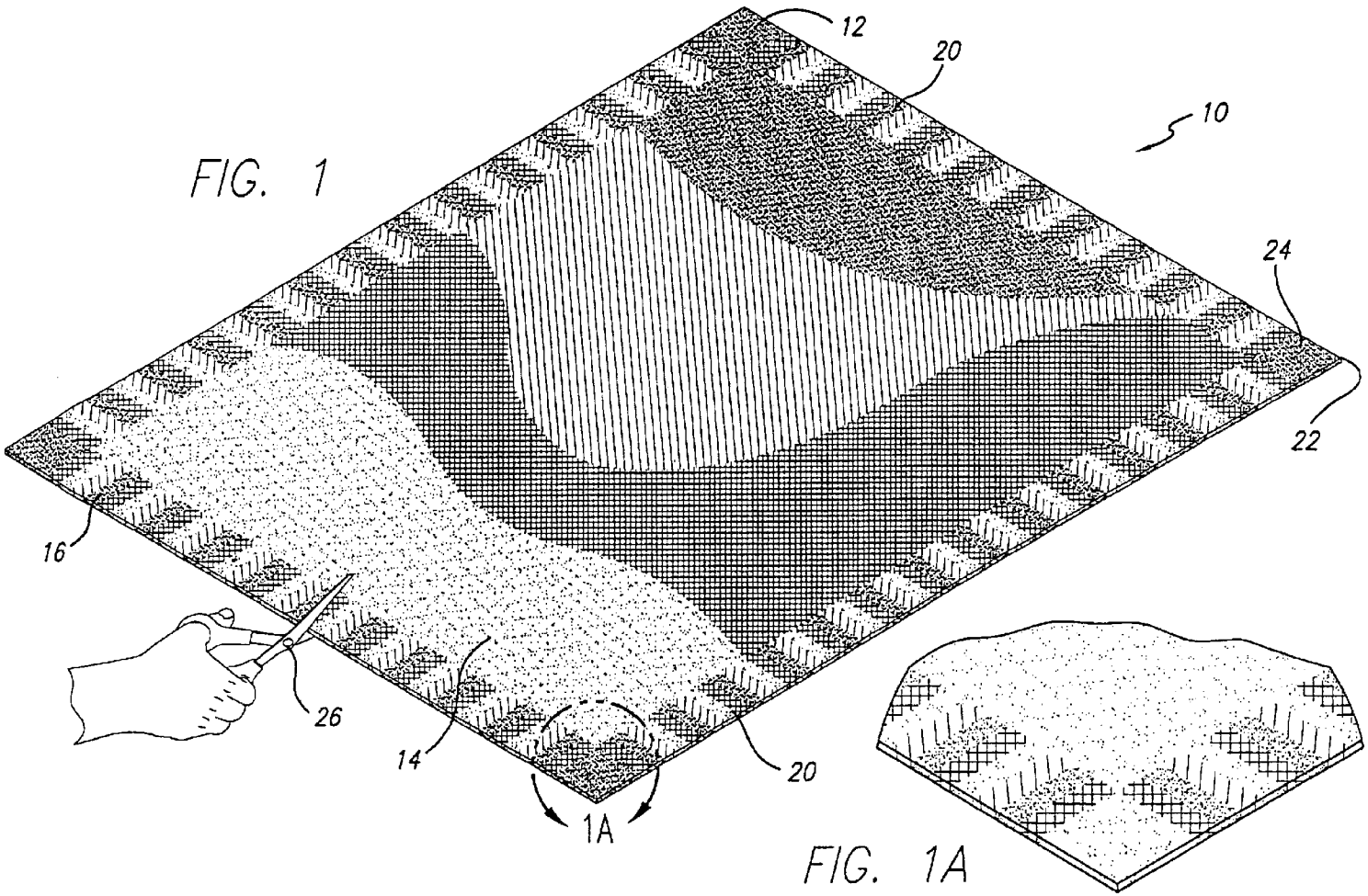
FIG. 1 is a perspective view of the improved fabric "throw" of the present invention with the simulated fringe.
FIG. 1A is an enlarged section of the improved fabric "throw" of FIG. 1 shown within circled line 1A in FIG. 1.
Figures 2, 2A:
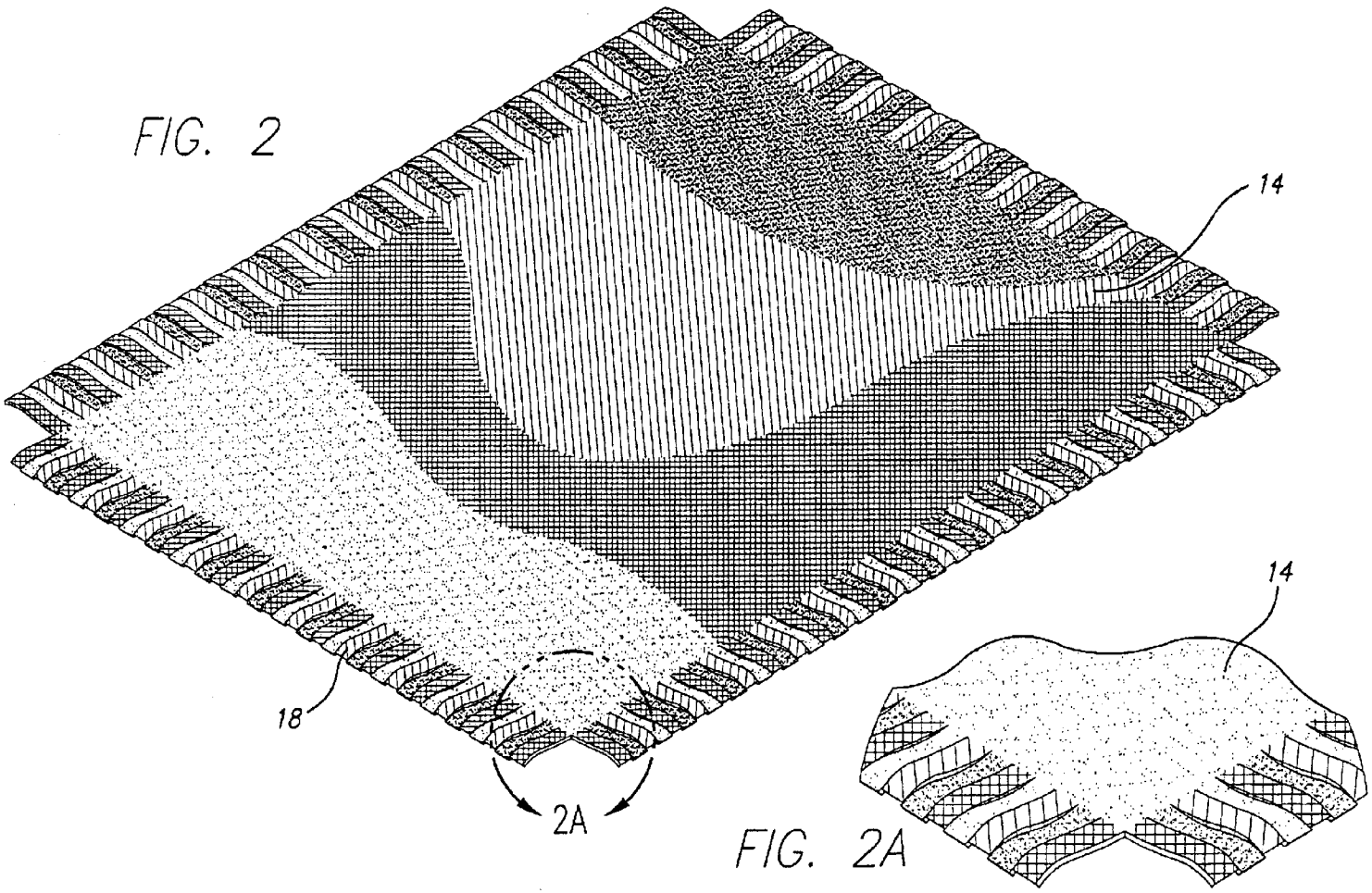
FIG. 2 is a perspective view of the improved fabric "throw" of the present invention with the simulated fringe separated into individual pieces of fringe material and the corners of the "throw" excised.
FIG. 2A is an enlarged section of the improved fabric "throw" shown within circled line 2A of FIG. 2.

Referring more particularly to the drawings, FIG. 1 is a perspective view of the present invention depicting a textile fabric article 10 with an uncut fringe-like border 12. Textile fabric article 10 can be used as any type of cloth covering as, for example, on a bed or to keep a person warm while sitting in a chair or elsewhere, or can also be used as a wall hanging or some similar item of artistic creation. Article 10 is comprised of a natural or synthetic fabric, or a combination of both. Dimensions of article 10 may vary from three or four feet square to several additional feet in width and length. The configuration of article 10 tends to be square or rectangular, though round, oval, and other shapes may be employed.

The principal component or field 14 of article 10 bears indicia, designs and/or color combinations that are intended to be aesthetically pleasing and marketable. Field 14 is bordered by a simulated fringe component 16, which employs colors, tones and textures that attempt to coordinate closely with the designs, textures, tones and colors displayed on field 14.

Fringe component 16 comprises a multitude of simulated individual fringe strips 18 defined by subtle lines of demarcation 20 which delineate one strip from another. At the corners 22 of article 10 are corner pieces 24 which can be removed either before or after strips 18 are physically separated from each other by a scissors 26, or some other sharp instrument. The separated strips 18 comprise an attractive fringe surrounding the fabric article 10 with colors, tones and textures that effectively coordinate with their counterpart components displayed within the field 14 of the article. Depending upon the prescribed line and/or color indicator that one employs as the place to separate the strips, an aesthetically effective variety of color, tone and texture combinations are available. For example, by separating the strips 18 along one line of demarcation 20 and/or color indicator, in lieu of another alternative place of separation, one can create an entirely different aesthetic look, particularly when contrasted against the designs, indicia, colors, tones and/or textures of field 14.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

What is claimed is:

1. A blanket comprising:

a generally rectangular shaped textile article comprised of a single piece of fabric having a top surface and a bottom surface with indicia disposed over portions of said top and bottom surfaces, a top edge and a bottom edge, and first and second side edges, said edges defined by a border comprised of a fringe having a plurality of simulated individually separate strips of material with indicia thereon;

wherein each of said strips of material has corresponding borders on each side comprised of prescribed lines and color indicators for use in physically separating said strips of material or combination of strips of material into assorted groupings, each of said groupings having a distinctive and aesthetically pleasing visual effect.

2. The invention of claim 1 wherein said simulated strips of material are converted to individual pieces of fringe material by physically separating said simulated strips of material along said prescribed lines and color indicators to allow for an aesthetically effective variety of color, tone and texture combinations.

3. The invention of claim 1 wherein said simulated strips of material are color coordinated with the indicia on said top and bottom surfaces.

4. The invention of claim 1 wherein the design of said simulated strips of material coordinate in color, tone and/or texture with the indicia on said top and bottom surfaces.

5. The invention of claim 1 wherein the corners of said rectangular textile fabric are excised.

* * * * *